US009185960B2

(12) United States Patent
Park et al.

(10) Patent No.: US 9,185,960 B2
(45) Date of Patent: Nov. 17, 2015

(54) STYLUS FOR COSMETICS, NAIL POLISH APPLICATOR AND SYSTEMS AND KITS BASED THEREON

(71) Applicant: Julep Beauty, Inc., Seattle, WA (US)

(72) Inventors: Jane Park, Seattle, WA (US); Albert Han Leung, San Francisco, CA (US); Pontus Kaj Bjorn Wahlgren, San Francisco, CA (US); Alyson Marie Yamada, Stanford, CA (US); James R. Yurchenco, Palo Alto, CA (US)

(73) Assignee: JULEP BEAUTY, INC., Seattle, WA (US)

( * ) Notice: Subject to any disclaimer, the term of this patent is extended or adjusted under 35 U.S.C. 154(b) by 0 days.

(21) Appl. No.: 14/076,072

(22) Filed: Nov. 8, 2013

(65) Prior Publication Data

US 2015/0128980 A1 May 14, 2015

(51) Int. Cl.
*A45D 34/04* (2006.01)
*A45D 29/00* (2006.01)

(52) U.S. Cl.
CPC ..... *A45D 34/045* (2013.01); *A45D 29/00* (2013.01)

(58) Field of Classification Search
CPC ..... A45D 29/00; A45D 29/20; A45D 34/00; A45D 34/042; A45D 34/043; A45D 34/045; A45D 34/046; A45D 40/262; A45D 40/265; A45D 40/267
See application file for complete search history.

(56) References Cited

U.S. PATENT DOCUMENTS

| | | | | |
|---|---|---|---|---|
| 5,071,277 | A * | 12/1991 | Braun | 401/126 |
| 6,109,442 | A | 8/2000 | Roegner | |
| 7,823,593 | B2 | 11/2010 | Gueret | |
| 2004/0182410 | A1 * | 9/2004 | Gueret | 132/218 |
| 2008/0283083 | A1 | 11/2008 | Piao | |
| 2012/0055505 | A1 * | 3/2012 | Piao | 132/313 |
| 2012/0294666 | A1 * | 11/2012 | Jang | 401/126 |

FOREIGN PATENT DOCUMENTS

| | | | |
|---|---|---|---|
| EP | 1452111 | A1 | 2/2004 |
| EP | 2084986 | A2 | 8/2009 |
| FR | 2898469 | A1 | 9/2007 |

OTHER PUBLICATIONS

International search report dated Jul. 7, 2014 issued in corresponding PCT application PCT/US2013/069335 cites the U.S. patents, U.S. patent application publication and foreign patent documents listed above.

* cited by examiner

*Primary Examiner* — Rachel Steitz
(74) *Attorney, Agent, or Firm* — DLA Piper LLP (US)

(57) ABSTRACT

A stylus for use in the application of a cosmetic includes a wand member having a beveled end with a bevel angle and a second end opposite the beveled end; a cup member having beveled end with the bevel angle and second end opposite the beveled end; a connection member comprising one of a magnet or a metallic material, the connection member being fixably attached to the second end of the cup member; and a protrusion extending from the end face of the second end of the cup member; wherein the wand member and cup member are rotatably connected along an axis of rotation at their respective beveled ends.

14 Claims, 19 Drawing Sheets

12
10
15
11
16
14
A
A
12
10
11
14
A
A
$d_1$
15
14
$d_4$
$d_3$
$d_5$
$d_2$
Section A-A
W
L

STYLUS FOR COSMETICS, NAIL POLISH APPLICATOR AND SYSTEMS AND KITS BASED THEREON

BACKGROUND

As shown in FIG. 17, a conventional nail polish ordinarily comes in a bottle having a cap attached to a shaft with an applicator brush, which is stored in the nail polish. The grip point of traditional nail polish applicators is the cap attached to the end of the applicator shaft opposite of the brush. When the brush is removed from the bottle, it is typically grasped predominantly with the fingertips. Further, the grip point (i.e., the cap) in the conventional system is also distant from the brush head of the applicator and from the shaft. As a result, a common problem with applying nail polish is the lack of adequate fine control of the brush—especially when applying nail polish with a non-dominant hand.

Further, few users of cosmetics are fully ambidextrous. Users typically have a dominant hand (often the right hand) that is more dexterous and capable of finer muscle control than the non-dominant hand (often the left hand). However, self-application of nail polish typically requires use of both the dominant and non-dominant hand of the user. During application, a user's hand may be oriented in a variety of configurations during the process of applying polish to the various fingers on both hands. As such, a conventional stylus structure having only a single rigid configuration is not optimal for use in both the dominant and non-dominant hand and all hand orientations.

There has also been a recent trend to more complex nail polish designs that associated with greater aesthetic and creative design requiring a significant amount of fine control over the application of polish. Associated with these trends are a variety of nail art tools that enable, for instance dotting and fine lines, on the human nail. However, conventional nail polish is sold with a single, fixed brush that is generally accommodated in bottles. As a result, conventional nail polish systems, standing alone, are not well suited for use with modern nail art.

As such, there is a need for improved nail polish applicators that enable fine control of the application of the polish to the nail and that permit efficient use of a variety of brush types. There is also a need for nail polish applicators that are configurable for use in both the dominant and non-dominant hand of a user as well as in various hand configurations.

BRIEF SUMMARY OF THE INVENTION

One object of the present invention is an ergonomic applicator that provides a greater degree of fine muscle control with both the dominant and non-dominant hand of a user.

Another object of the present invention is to provide a configurable applicator whose configuration may be changed to suit the needs of an individual user especially during use with both the dominant and non-dominant hand.

In a first embodiment of the present invention, a stylus for use in the application of a cosmetic comprises a wand member having a beveled end with a bevel angle and a second end opposite the beveled end; a cup member having a beveled end with the bevel angle and second end opposite the beveled end; a connection member comprising one of a magnet or a metallic material, the connection member being fixably attached to the second end of the cup member; and a protrusion extending from the end face of the second end of the cup member; wherein the wand member and cup member are rotatably connected along an axis of rotation at their respective beveled ends. The connection member is preferably a magnetic member.

In a preferred embodiment, the rotation of wand member relative to the cup member is restrained at two or more predetermined positions along the axis of rotation. In a first preferred predetermined position, the stylus is aligned along the entire length of its a longitudinal axis. In a second preferred predetermined position, the stylus is bent at the connection of the cup member and the wand member.

In a preferred embodiment, the beveled end of the wand member comprises at least two detents or at least 2 detent receptacles and the beveled end of the cup member comprises the other of the least two detent or detent receptacles, and the detent receptacles are configured to restrict the rotation of wand member relative to the cup member at the predetermined positions along the axis of rotation when the detents are aligned with the detent receptacles. In a preferred embodiment, each detent is seated in a corresponding by a spring force directed parallel to the axis of rotation.

Preferably, the beveled end of the wand member comprises a first conic contact surface and the beveled end of the wand member comprises as a second conic contact surface and the first conic surface is engaged with the second conic contact surface and the rotation is along the contact surfaces.

An applicator for use in the application of a cosmetic comprises the stylus according the first embodiment and an overcap assembly comprising a cap and an overcap member fixably attached to a top surface of the cap, the overcap member being a metallic material or a magnet of suitable polarity, wherein the overcap assembly is reversibly connected to the stylus by a magnetic force between the connection member and the overcap member.

A system for polishing nails comprises the stylus according to present embodiment and at least one overcap assembly connected to a brush assembly, the overcap assembly being configured to reversibly attach to the stylus; and optionally, at least one container of nail polish. The system may comprise a plurality of overcap assemblies each having a different brush assemble, each overcap assembly being reversibly attachable to the stylus.

A kit for polishing nails comprising the stylus according to the present invention, at least one overcap assembly connected to a brush assembly, the overcap assembly being configured to reversibly attach to the stylus; at least one container of nail polish; a container adapted for holding the stylus, the at least one brush and the at least one nail polish. The kit may comprise a plurality of overcap assemblies each having a different brush assembly, each overcap assembly being reversibly attachable to the stylus.

One object according to a second embodiment of the present invention is to provide an applicator that includes a stylus with a connection portion adapted to reversibly attach a variety of brush heads. Preferably, the brush heads are interchangeable with other nail art tools to enable dotting and line art.

An applicator for use in the application of a cosmetic according to a second embodiment of the present invention includes a stylus and a brush head reversibly attached to the stylus. A stylus for use in the application of a cosmetic includes a connection portion comprising a first end defining an opening and a bore; a grip portion adapted for being gripped with a human hand disposed closer to the first end than a second end of the stylus opposite the first end along a major axis of the stylus; and a connection mechanism, at least a portion of which is accommodated in the bore. The brush head includes a brush attached to one surface of a shield and a connector attached to a second surface of the shield. When the connector of the brush head is inserted into the bore of the stylus, the connector engages the connection mechanism of the stylus, thereby reversibly attaching the brush head to the stylus.

A system for polishing nails according to the second embodiment includes a stylus according to the second embodiment, at least one brush head capable of reversibly attaching to the stylus; and at least one container of nail polish. A container for using nail polish according to the present invention has a wider opening than conventional containers. This permits a user to finely control the amount of nail polish on the brush and to avoid getting nail polish on the applicator. In a preferred embodiment, the system includes a plurality of brush heads, each of which is reversibly attachable to the stylus.

A kit for polishing nails according to a second embodiment of the present invention includes a stylus according to the present invention, at least one brush head capable of reversibly attaching to the stylus; at least one container of nail polish; and a container adapted for holding the stylus, the at least one brush and the nail polish. In a preferred embodiment, the kit comprises a plurality of brush heads, each of which is capable of reversibly attaching to the stylus. Preferably, the kit comprises a plurality of containers, each container comprising nail polish.

BRIEF DESCRIPTION OF THE FIGURES

FIG. 1(*b*) is a perspective view of an overcap assembly and nail polish container useable in connection with the stylus. FIG. 1(*c*) is a side view of an overcap assembly having a nail polish brush attached to the overcap assembly. FIG. 1(*d*) is a perspective view of the overcap and brush assembly attached to the nail polish container.

FIG. 2(*b*) is a perspective view of the stylus attached to the overcap assembly and container. FIG. 2(*c*) is a perspective view of the stylus, overcap assembly and brush after being removed from the container.

DETAILED DESCRIPTION OF THE INVENTION

Although the embodiments of the present invention described herein are generally described with reference to the application of nail polish, it should be understood that the applicator, including the stylus, overcap assemblies and brush heads described herein, and the systems and kits of the present invention are suitable for use with any cosmetic and especially liquid cosmetics for which fine control of the application of the cosmetic is advantageous.

First Embodiment

A first embodiment of the present invention is shown for instance in FIGS. 1-11.

Figures 1A, 1B, 1C, 1D:
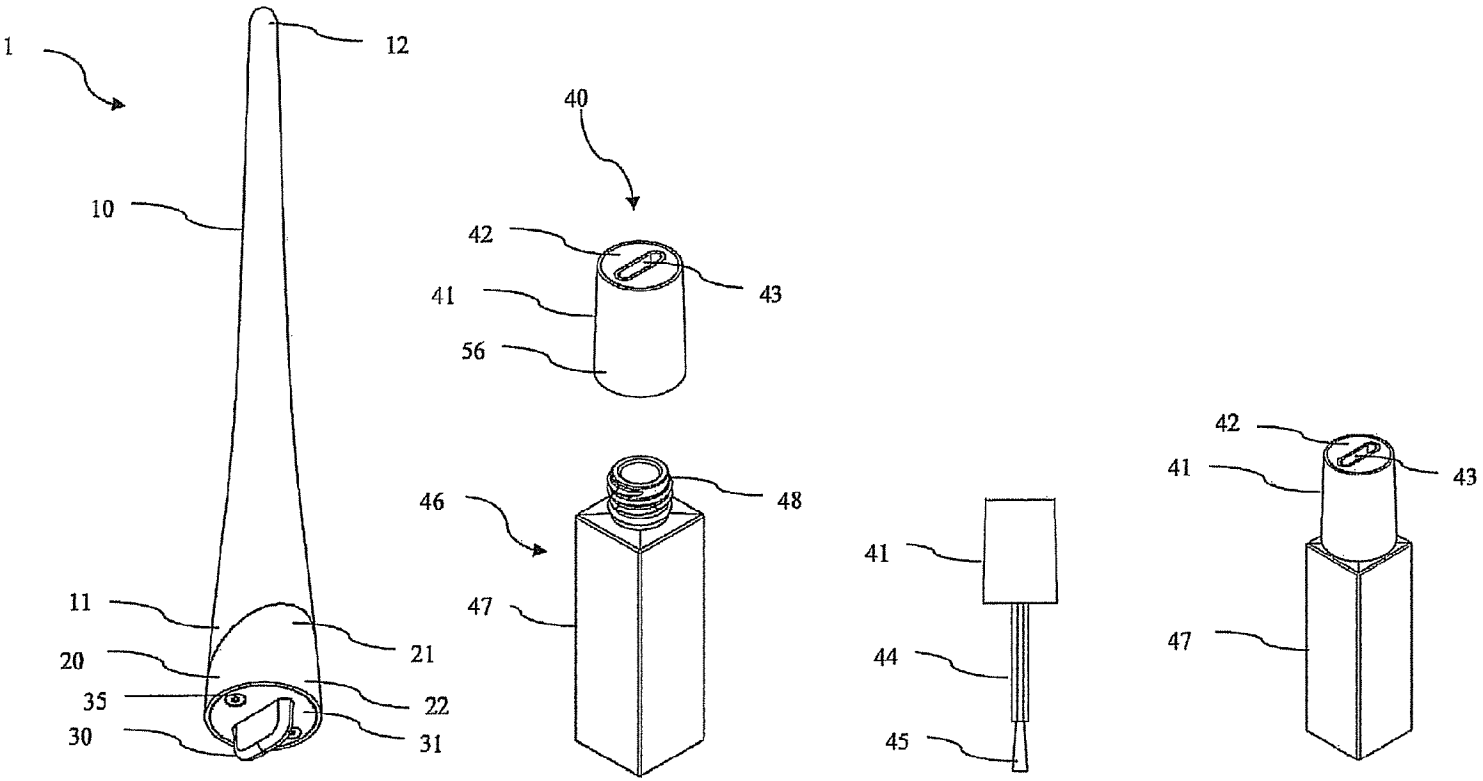
FIG. 1(*a*) is a perspective view of a stylus for use in the application of cosmetics, especially nail polish, according to one embodiment of the present invention.

A stylus according to a first embodiment that is adapted for use with an overcap assembly and, optionally, a container of nail polish or other cosmetic is shown in FIG. 1(*a*).

As shown in FIG. 1(*a*), a stylus 1 comprises a wand member 10, a cup member 20, protrusion 30, and a magnet member 31. Wand member 10 has a major axis along a longitudinal direction (defined as direction "L" in FIG. 6(*b*)), and a minor axis referred to herein the width direction (defined as the "W" direction in FIG. 6(*b*)) in that the wand member is longer along the longitudinal direction than along the width direction. The cross-sectional shapes of the wand member 10, cup member 20 and magnet member 31 in the width direction is not particularly limited, but the respective cross-sectional shapes are preferably the same. Further, the cross-sectional shapes of the wand member and magnet member should be suitably selected such that the resulting stylus fits comfortably in the hand of the user. Preferably, the cross-sectional shape of the wand member 10 and the cup member 20 in the widthwise direction is round. The stylus, including the wand member and cup member, may generally be made of any suitable material or combination of materials generally used by the cosmetics industry, so long as the weight of the stylus is such that it may be comfortably held in the user's hand.

Suitable materials include plastics and other polymers, woods and metals and combinations thereof. Preferable materials include molded plastic.

The wand member 10 has a beveled end portion 11 connected to a cup member 20 and a second end portion 12 opposite the beveled end. In a preferred embodiment, the wand member gradually tapers so that it is wider in widthwise direction at the beveled end 11 than at the second end 12. The taper functions to reduce weight and material costs.

The cup member 20 includes a beveled end portion 21 and a second end portion 22 opposite the beveled end portion. The beveled end portion 21 of the cup member 20 and the beveled end portion 11 of the wand member 10 have the same bevel angel. As such, when connected as shown in FIG. 1(*b*) for example, the wand member 10 and cup member 20 are aligned along the longitudinal axis in a first configuration. In the present embodiment, the wand member 10 and the cup member 20 are preferably rotatably connected at their respective beveled ends, and as such, the wand member 10 and cup member may rotate with respect to one another.

The size of the bevel angle is not particularly limited. Preferably, the bevel angle is between 5° and 85°, preferably between 25° and 65° and more preferably about 45°.

The end face of a second end 22 of the cup member 20 is circular in cross-section, and the end face is substantially normal, and more preferably normal to the longitudinal axis. A magnet member 31 is used to connect the stylus to an overcap assembly by a magnetic force. The magnet member 31 preferably has a substantially planar surface and is fixably attached at or near the end face of the second end 22. The magnet member 31 is preferably disc shaped with an opening through which a protrusion 30 extends. In the embodiment of FIG. 1(*a*) the magnet member 31 is attached to the end face of the cup member 20 by screws 35.

Figure 4:
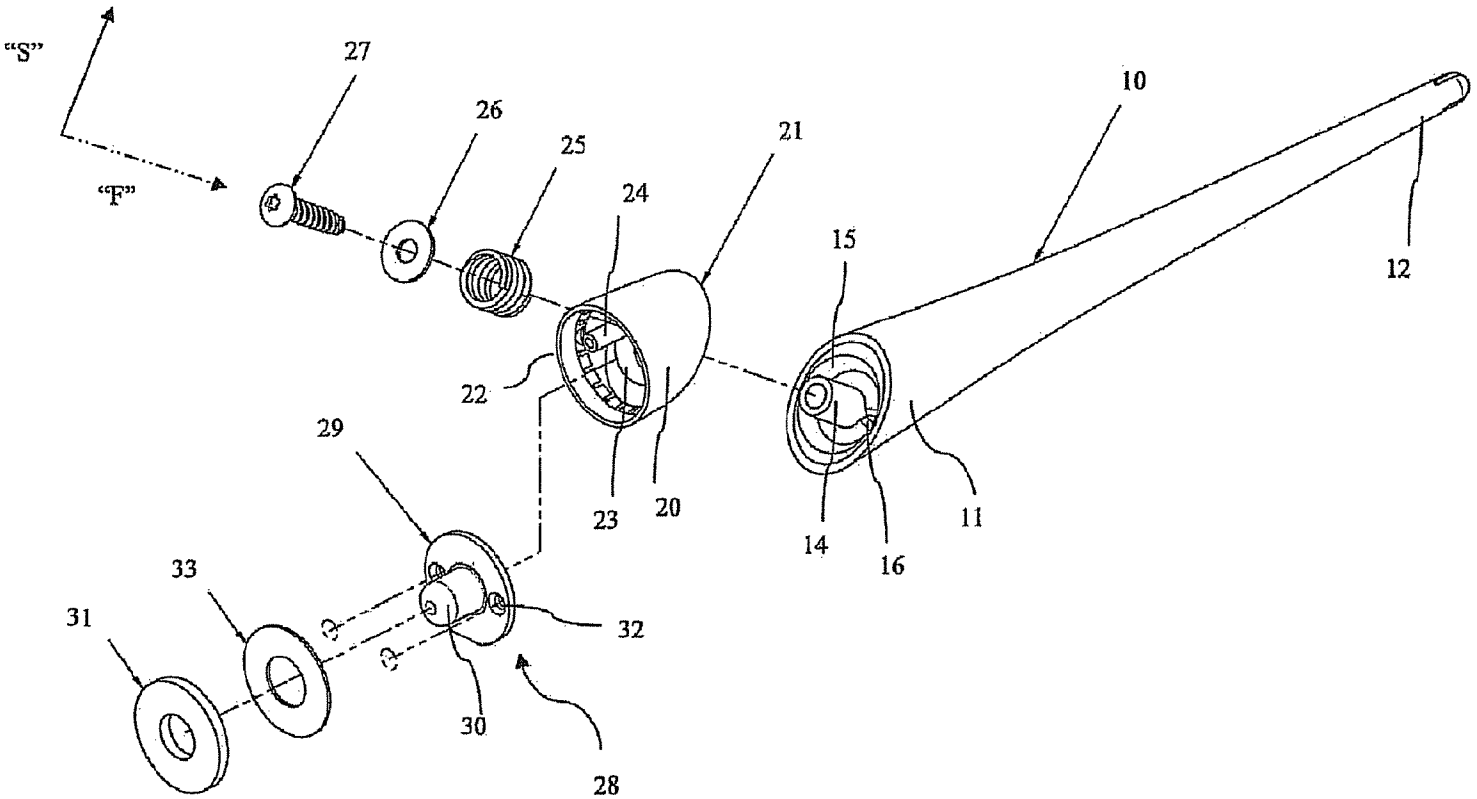
FIG. 4 is an exploded view of one example of a construction of a stylus comprising a wand member, a cup member, a post member and a magnet member according to the first embodiment of the present invention.

A (preferably) non-magnetic protrusion 30 extends from the surface of the magnet member along the longitudinal axis. The protrusion 30 ensures that the respective axes of the stylus 1 and an overcap assembly 40 remain aligned when the stylus 1 is attached to the overcap assembly and while the stylus 1 is in use by a user. The shape of the cross-section of the protrusion perpendicular to the longitudinal axis is not particularly limited. In FIG. 1(*a*) the protrusion is spade shaped and the corresponding cross-section is substantially rectangular. Preferably, the cross-sectional shape of the protrusion is circular, as shown in FIG. 4.

Figure 10B:
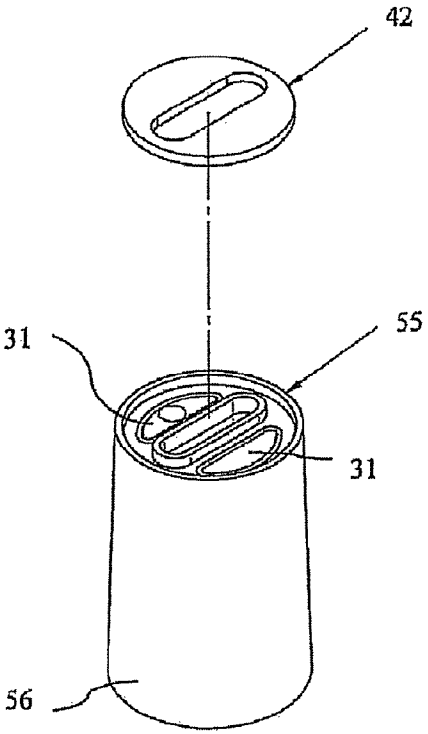
FIG. 10 is (a) a perspective view and (b) an exploded view of an overcap assembly according to another embodiment of the present invention.
Figure 10A:
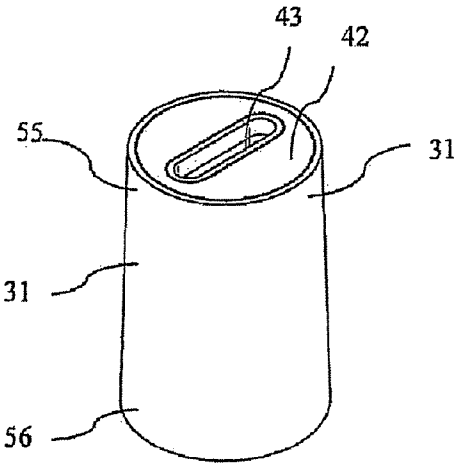

A system for the application of nail polish or other cosmetics according to the present invention includes a stylus of the present invention, at least one overcap assembly 40 and, optionally a container 46 that contains a nail polish solution. As shown in FIGS. 1(*b*) and 10(*a*) overcap assembly 40 includes a cap 41 and an overcap member 42. The cap 41 preferably has the same cross-sectional shape in the width direction as both the wand member 10 and the cup member 20. The overcap member 42 is a either a metallic material or a magnet of opposite polarity to magnet member 31. Overcap member 42 preferably has a substantially planar upper surface and is fixably attached at or near the top end face of cap 41. As shown in FIG. 10(*b*), the overcap member 42 is preferably disc shaped with an opening 43 therethrough which corresponds to the cross-sectional shape of protrusion 30 and extends inwardly from the top of the cap so that protrusion 30 of stylus 1 may pass through opening 43. Preferably, the cross sectional size and shape of protrusion 30 and cap assembly opening 43 are such that there is no significant movement of the stylus relative to the cap assembly 40 in the width direction. As shown in FIG. 10*b*, the top portion 55 of cap 41 also has an opening therethrough which also preferably corresponds to the cross-sectional shape for passage of protrusion 30 into the interior of cap 41. In the embodiment of FIG. 10(*b*) the overcap member 42 is attached to the top face of the cup 41 by glue. Surface embossing 57 may be added to the top surface of cup 41 to distribute glue more evenly.

In a separate embodiment, cap 41 may have an integrated top end that is either metallic or a magnet having an opposite polarity of magnetic member 31 of stylus 1.

In operation, referring to FIGS. 1(*a*) and (*b*), stylus 1 may be connected to the overcap assembly 40 when a user brings magnet member 31 of stylus 1 in sufficiently close proximity to (and preferably touching) overcap member 42 to generate an attractive magnetic force between magnet member 31 and overcap member 42 and protrusion 30 is inserted into opening 43. Preferably, a flat surface of magnet member 31 is flush against a flat surface of overcap member 42. The amount of magnetic force should be sufficient to securely fasten the stylus 1 to the overcap assembly 40 during normal use by a user. The overcap assembly 40 may be detached when a user exerts sufficient force to overcome the magnetic force and separate the overcap assembly 40 from the stylus 1. In this manner the overcap assembly may be reversibly attached and detached.

Although in the embodiment of shown in FIGS. 1(*a*) and (*b*), the stylus comprises magnetic member 31, in another embodiment, a non-magnetic metallic member may be substituted for magnetic member 31 if the corresponding overcap assembly is fitted with a magnetic member. More broadly, it is sufficient that one of the stylus and overcap be fitted with a magnet member and the other be fitted with either a magnetic member of opposite polarity or a metallic member.

As shown in FIG. 1(*b*) an optional container 47 contains a cosmetic, preferably a nail polish, that includes a top end 48 having means for connecting the container 47 to the cap assembly 40 such as a threaded structure shown in FIG. 1(*b*). The cap assembly 40 may contain integrated means (not shown) for connecting to the cap assembly 40 to container 47 or a separate connecting member (not shown) may connect the cap assembly 40 to container 47. The methods and structures for making such connections are well known in the prior art. A container 47 attached to a cap assembly 40 in a closed state is shown in FIG. 1(*d*).

Figure 11:
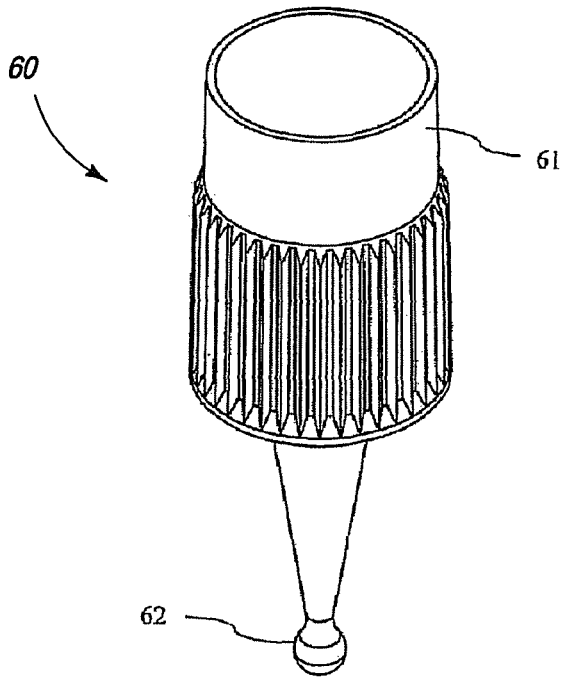
FIG. 11 is a dotting tool as brush assembly.
Figure 12:
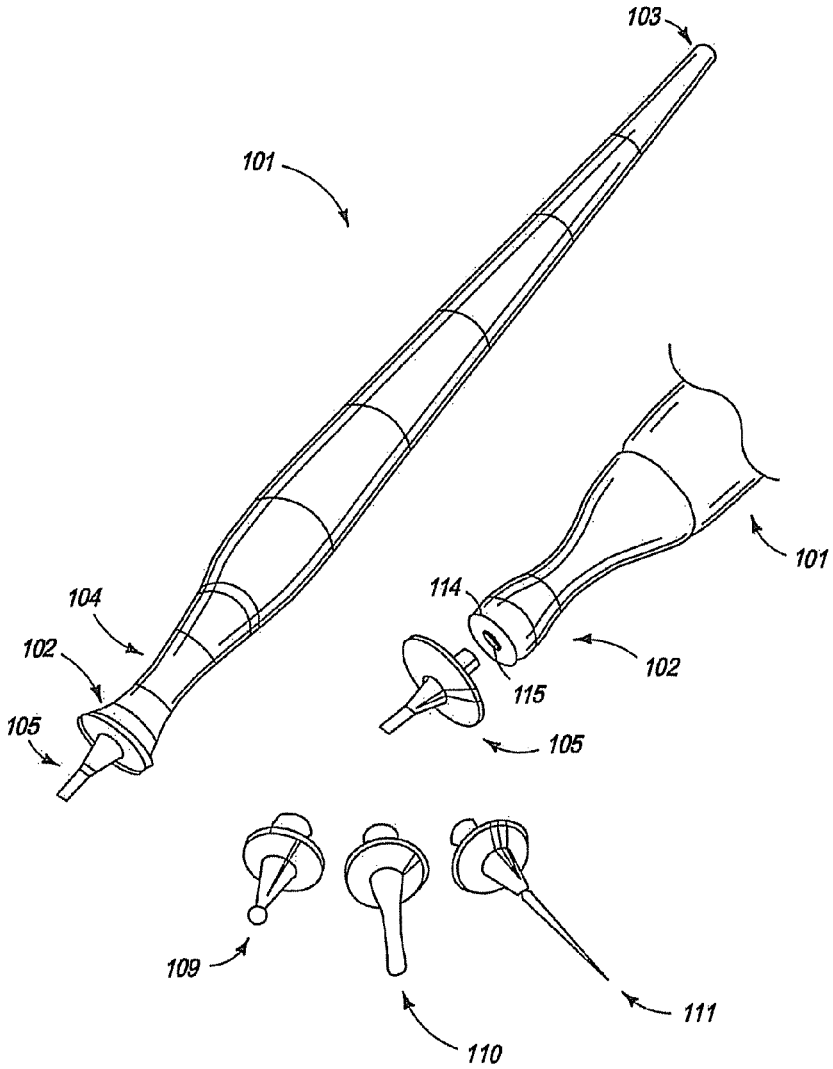
FIG. 12 is a perspective view of a cosmetics applicator including a stylus and a detachable brush head according to a second embodiment of the present invention.

As shown in FIG. 1(*c*), the cap assembly 40 may be fitted with a brush assembly having a stem 44 and a brush 45. The brush assembly may be integrally formed with the cap assembly 40 or the brush assembly may be a separate member that is inserted into the bottom end portion of the cap assembly. Although a conventionally shaped brush for nail polish is shown in FIG. 1(*c*), the brush 45 may generally be any brush form that is suitable for use in connection with nail polish application. Alternative styles of brushes include a larger brush shape or a striping brush. The brush assembly may also be a dotting tool 60 such as shown in FIG. 11. As shown in FIG. 11, a dotting tool 60 includes top portion 61 that is inserted into the bottom portion 56 of cap 41. By providing a variety of brushes and other tools, such as the dotting tool, a user can achieve a wide range of effects relating to the application of nail polish and therefore provide greater aesthetic and artistic control over nail polish designs.

Thus, a kit according to the present invention in may include the stylus 1 and more than one cap assembly 40, each assembly having a different brush or tool attached thereto. The system may optionally include on or more containers of polish containers, and optionally, a case for carrying the system.

Figures 2A, 2B, 2C:
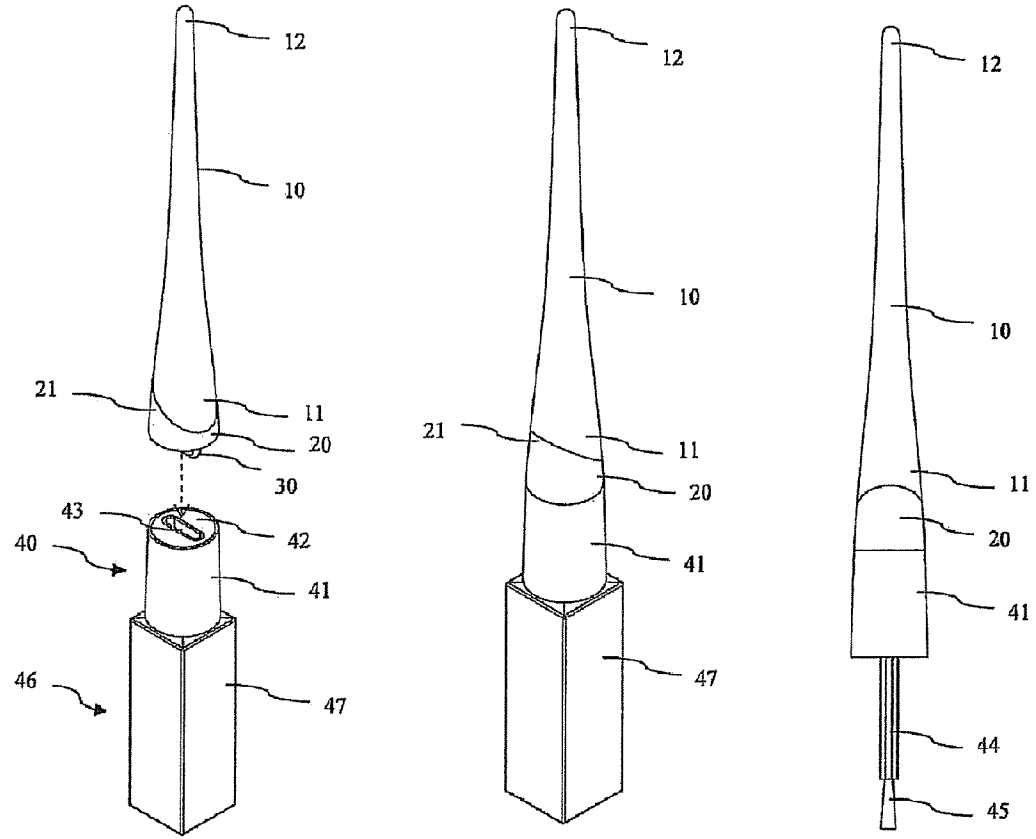
FIG. 2(*a*) shows the alignment of the stylus with the overcap assembly and container assembly when the stylus is to be attached to the overcap assembly according to the embodiment of the present invention.

FIG. 2 shows various stages in the operation of the stylus and nail polish system according to one embodiment of the present invention. As shown in FIG. 2(*a*), stylus 1 is connected to the overcap assembly 40 (here attached to container 26 preferably having a nail polish therein) when a user brings protrusion 30 and the associated magnet member of stylus 1 into contact with overcap member 42 with protrusion 30 inserted into opening 43 thereby establishing a suitable connection between stylus 1 and connection assembly 40 as shown in FIG. 2(*b*). Thereafter, the user can then remove the overcap assembly 40 and its associated brush assembly from the container 26 while maintaining a secure connection between the overcap assembly 40 and stylus 1 as shown in FIG. 1(*c*). In use with a nail polish system, nail polish solution in container 26 would be retained on brush 45 at the time it is removed from container 26, and the stylus 1 is then suitable for use in applying nail polish to a finger nail.

The combined stylus 1 and overcap assembly 41 with or without a brush assembly or other tool may be referred to herein as an "Applicator" or "Nail Polish Applicator" herein. One example is shown in FIG. 1(*c*). The applicator should be sufficiently sized to be comfortably held in the human hand. Preferably, the applicator should preferably be between 4 and 9 inches in length along its major axis, and more preferably between about 5 and 8 inches. The combined structure should have a weight that may be comfortably held in a typical user's hand, and the weight may be varied by varied by a number of known design choices, for instance, selecting suitable materials or suitable or the shape of the wand.

The length of the wand member 10, cup member and cap assembly 40 may be suitably selected by those ordinarily skilled according to the function and purpose of those members as described herein. Exemplary dimensions of wand 10 include the length $d_2$ of the wand shown in FIG. 6. The length $d_2$ is generally in the range of about 3 inches to 6 inches preferably about 4 to 5 and more preferably about 4.5. Thickness $d_1$ of the wand 10 in width direction is generally in the range of 0.25 inches to 1 inch, preferably about 0.4 inches to 0.8 inches and more preferably about 0.6 inches. Exemplary dimensions of cup member 20 include the length $d_6$ of the wand shown in FIG. 8. The length $d_6$ is generally 0.4 inches to 1 inch, preferably about 0.5 inches to 0.8 inches and more preferably about 0.6 inches. Thickness $d_7$ of the wand 10 in width direction is generally in the range of 0.25 inches to 1 inch, preferably about 0.4 inches to 0.8 inches and more preferably about 0.6 inches.

Few users of cosmetics are fully ambidextrous. Users typically have a dominant hand (often the right hand) that is more dexterous and capable finer muscle control than the non-dominant hand (often the left hand). However, self-application of nail polish typically requires use of both the dominant and non-dominant hand of the user. Further, a user's hand may be oriented in a variety of configurations during the process of applying polish to the various fingers on both hands. As such, a single stylus structure is not optimal for use in both the dominant and non-dominant hand and all hand orientations.

As such, the stylus of present embodiment is configurable by a user so that it can be adapted for use in a manner that maximizes control and comfort by the user. For example, FIG. 3(*a*) shows a configuration in which the axes of the wand member 10, cup member 20, cup 41 and brush assembly are substantially aligned along the longitudinal axis and may be typically be used in a user's dominant hand in a "pen like" or "pencil like" fashion that is not possible with traditional nail polish dispensers. Such a configuration may generally be used comfortably by many users in many orientations of their dominant hand.

Figure 3B:
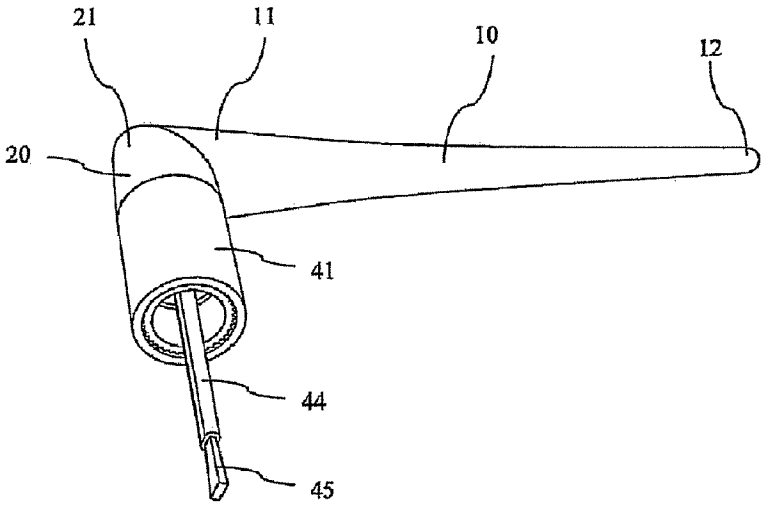
FIGS. 3(*a*) and 3(*b*) are perspective views of the stylus of the present invention rotatable around a beveled connection in the stylus in a straight (FIG. 3(*a*)) and angled (FIG. 3(*b*)) configuration.
Figure 3A:
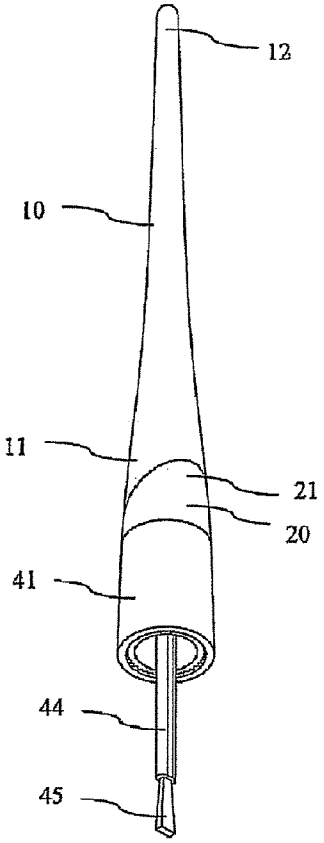

As shown in FIG. 3(*a*), wand 10 is rotatably connected at a beveled end 11 to a beveled end 12 of cup member 20, wherein beveled end 11 and beveled end 12 have the same bevel angle. In accordance with the present invention, the wand is rotatable at the beveled end 11 of wand 10 such the long axis of wand 10 is rotated at an angle (equal to twice the bevel angle) in relation to the cup member to achieve a so-called "bent" configuration as shown in FIG. 3. The so-called "bent" configuration is often desirable for persons working with their non-dominant hand. It should be noted that although FIG. 3 shows only 2 configurations, the wand may be positioned in any number of positions.

As will be explained in greater detail below, wand 10 may be connected to cup member 20 by joining the beveled end 11 of the wand 10 to a beveled end 21 of the cup member 20 along an axis of rotation and applying a joining force parallel to the axis of rotation that engages a contact surface of the stylus 1 with a contact surface of cup member 20. As a result the wand 10 and the cup member 20 are securely joined and are able to stably rotate about the axis of rotation along the contact surfaces. The stylus may be restrained to either the "pen like" or "bent" configurations by a detent system that positions and holds the cup member 20 in relation to wand member 10 in a restrained manner such that their relative position can be released only by a sufficient rotation force applied to one of the wand member and the cup member. Specifically, the beveled end 11 of stylus 1 comprises at least two detents or two detent receptacles, and the beveled end 21 of the cup member 20 comprises the other of the detents or detent receptacles. The number of detents may be adapted to the number of positions that is desired to be secured. Other manner of restraining the rotation may be applied.

Figure 5:
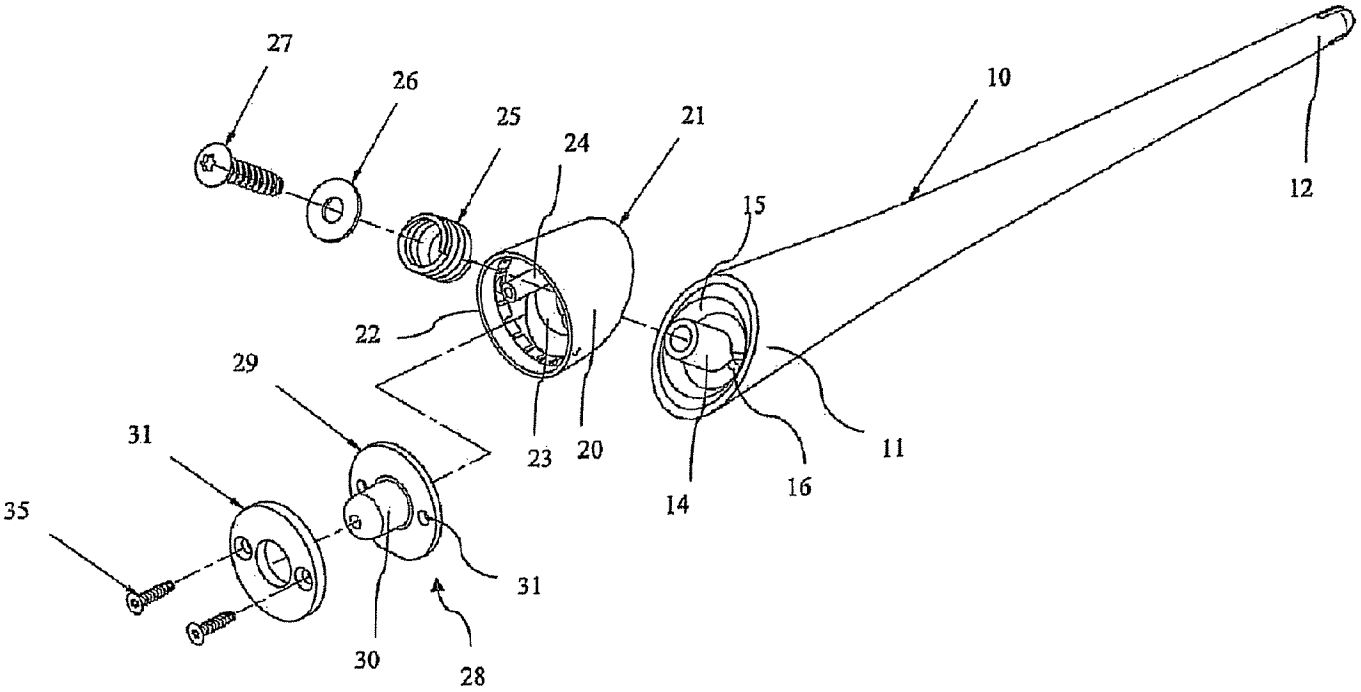
FIG. 5 is an exploded view of an example of an alternative construction of the stylus comprising a wand member, a cup member, a post member and a magnet member according to the first embodiment of the present invention.

An exemplary construction of a stylus 1 according to the present invention is shown in FIG. 4. An alternative exemplary construction of a stylus 1 is shown in FIG. 5. The structure of wand member 10 in these exemplary embodiments in shown in further detail in FIGS. 6 and 7. The structure of cup member 20 according to these exemplary embodiments is shown in detail, for instance, in FIG. 8. The structure of post 28 having protrusion 30 is shown in detail in FIG. 9.

Figures 6A, 6B, 6C:
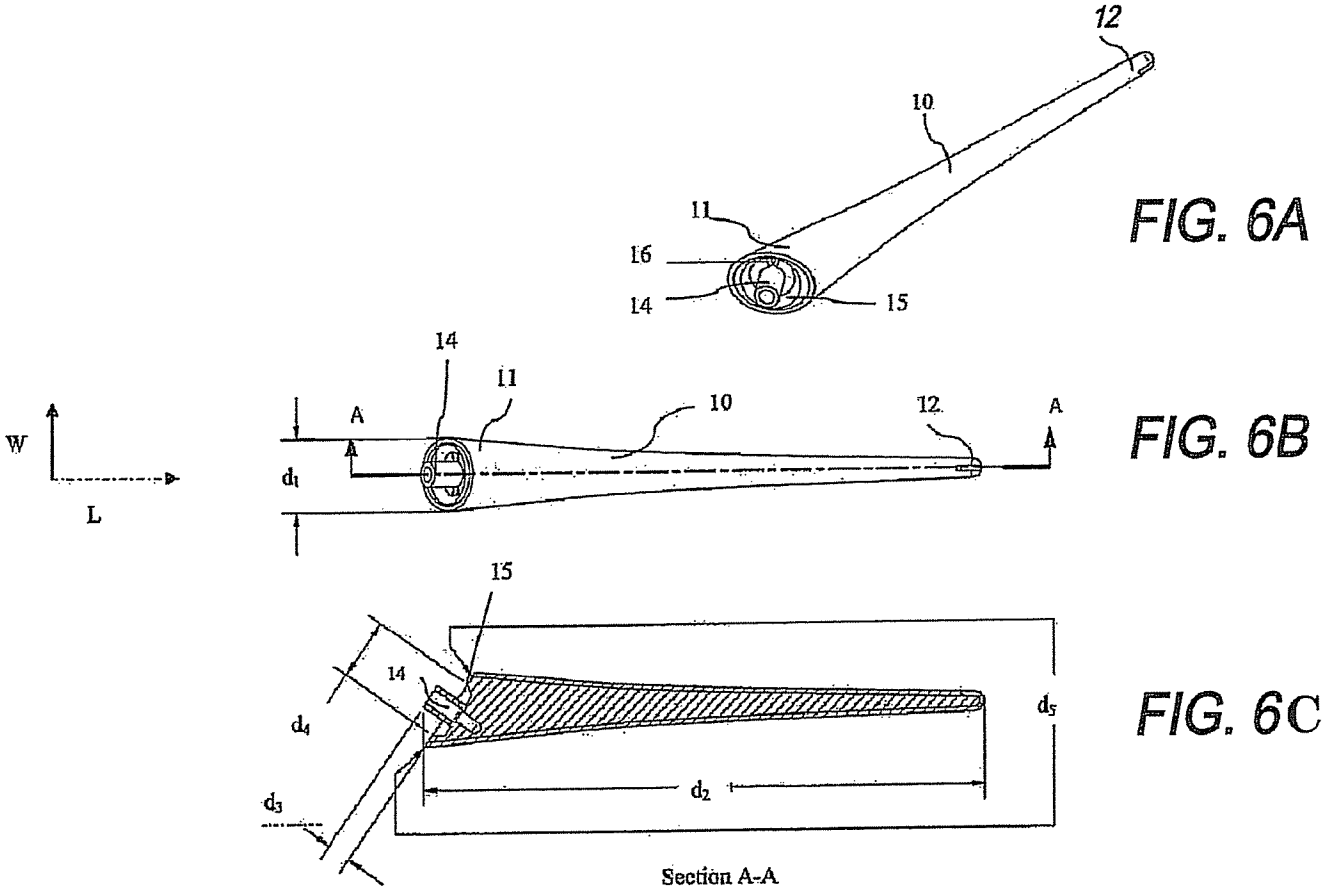
FIG. 6 is (a) a perspective view, (b) side view and (c) a cross-sectional view taken along an axis A-A of a wand member of a stylus according to the first embodiment of the present invention.
Figure 7B:
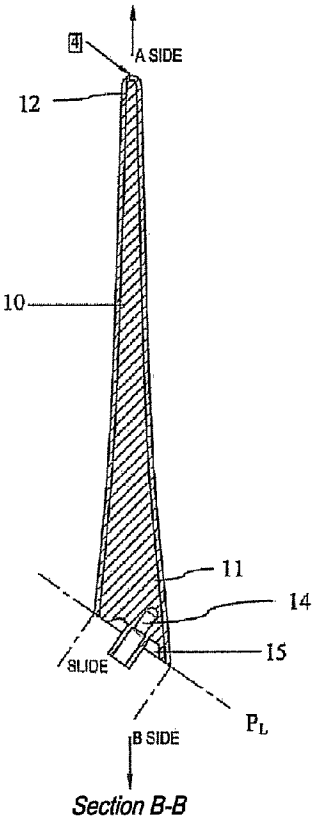
FIG. 7 is (a) a perspective view and (b) a cross-sectional view taken along an axis B-B of a wand member of a stylus according to the first embodiment of the present invention.
Figure 7A:
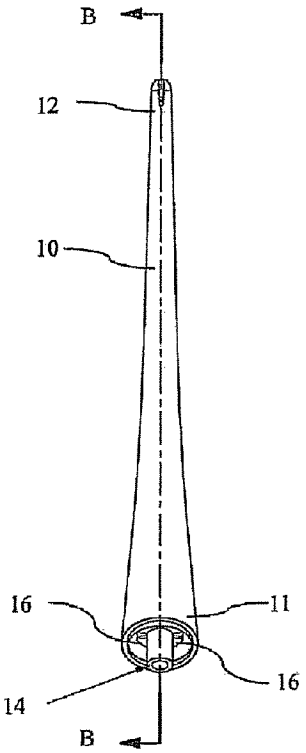
Figure 8A:
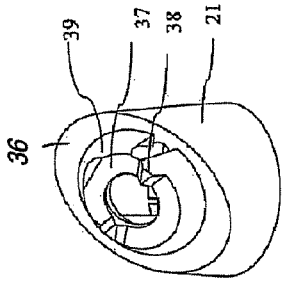
FIG. 8 is (a) a perspective view, (b) a second perspective view, (c) a cross-sectional view taken along a axis C-C of a cup member of a stylus according to a first embodiment of the present invention, (d) opposite surface of the cup member shown in (a).
Figure 8C:
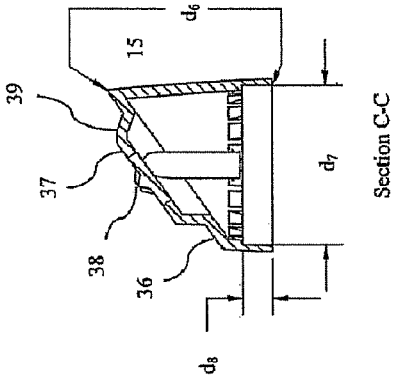
Figure 8B:
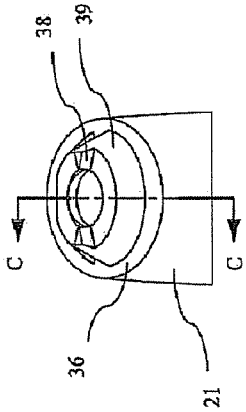
Figure 8D:
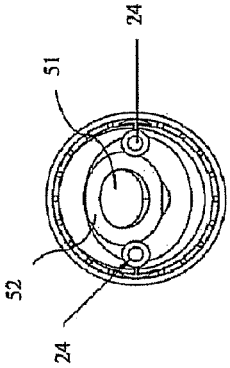
Figure 9A:
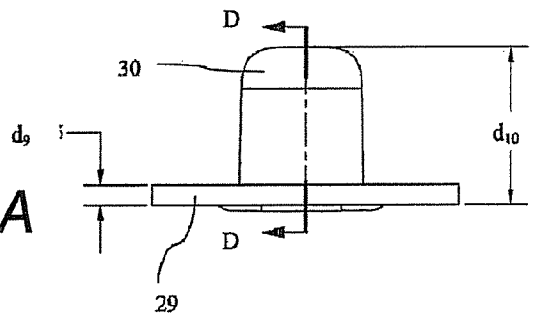
FIG. 9 is (a) a side view, (b) a cross-sectional view taken along an axis D-D, (c) a top view, and (d) a perspective view of a post member according to a first member of the present invention.
Figure 9B:
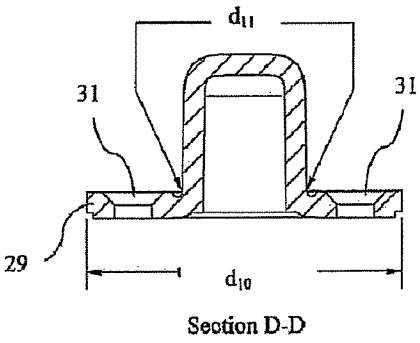
Figure 9C:
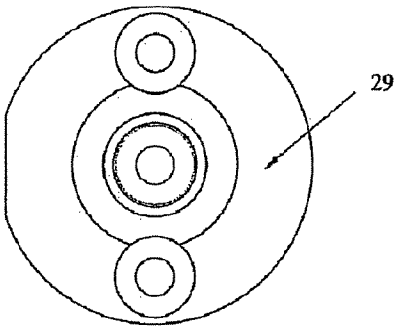
Figure 9D:
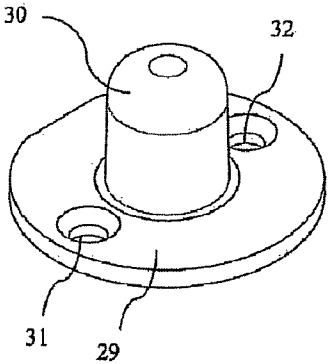

As shown in FIG. 4, wand member 10 further comprises boss 14, conic seating surface 15 and a pair of detent receptacles 16 (only one of which is shown in FIG. 4). As shown in FIGS. 6 and 7, the boss 14 extends outward from the end face of the beveled end 11 of wand 10 and is generally normal to the end face of beveled end 11. As shown in FIG. 6 (*b*), an exemplary distance for the distance $d_3$ is about 0.2 inches. Seating surface 15 of the beveled end 11 extends generally inward from the end face (See plane PL in FIG. 7(*b*)). The seating surface 15 is preferably conic shaped. A pair of detent receptacles 16 also extend inwardly from the end face of the beveled end 11. An exemplary distance $d_4$ in FIG. 6(*b*) is around 0.5 inches.

As shown in FIG. 8(*a*), the beveled end 21 of the cup member 20 has a connection structure extending from the end face 36 of the beveled end adapted for connection wand member 10 at its beveled end 11. The connection structure includes conic shaped seating surface 37 projecting from the end face 36, and a planar surface 37 with a pair of detents 38.

As shown in FIGS. 4 and 5, the wand member 10 may be connected to the cup member 20 at their respective beveled ends along a fixation axis "F" by aligning the wand member 10 having a boss 14, with a cup member 20, a spring 25, washer 26, and screw 27 in that order as shown in FIG. 4. Screw 27 is connected to boss 24 establishing an axis of rotation. The screw 27 urges washer 26 thereby pressing against spring 25 to create a spring force connecting cup member 20 to wand member 10 at their respective beveled ends. Specifically spring 26 abuts surface 52 of cup member 20 shown in FIG. 8(*d*) which is opposite surface 37 of the cup member 20 shown in FIG. 8(*a*).

As a result of the application of the spring force, the connection of beveled end 22 is pressed against the corresponding structures in the beveled end 11, and conic seating surface 39 of cup member 20 shown in FIG. 8(*a*) is engaged with its counterpart seating surface 15 in beveled end 11 so that the wand member 20 can be stably rotated around the axis of rotation with respect to the cup member 20. Further, when detents 38 of the cup member 20 are aligned with detent receptacles 16 of the wand member 10, the spring force causes the detents 38 to be seated in the detent receptacles 16. When a user rotates the cup member 20 with respect to the wand member 10, detents 38 are pressed against sides of detent receptacles 16 and cause a force to be applied to the spring 25 and when sufficient force is applied, detents can leave their respective detent receptacles.

In the constructions of FIGS. 4 and 5, the connection structure shown in FIG. 8(*a*) extend outwardly from the end face 26 of beveled end 21 of cup member 20 and the corresponding surfaces of the cup member extends inwardly from the end face of the beveled end 11 of wand member 10, it should be understood that, alternatively, the connection structure could reverses so that it extends inwardly on beveled 21 and outwardly from beveled end 11.

The manner of attaching protrusion 20 and magnet member 31 to the end face of the second end of cup member 20 is not particularly limited. An exemplary construction of the protrusion 30 and magnet member 31 at the end face of the second end 22 of cup member 20 is also shown in FIGS. 4 and 5. As shown in FIG. 4, the assembly comprises a magnetic member 31, double sided tap 33, screws 35 (represented virtually as small dotted circles in FIG. 4), a post 28 and bosses 24 integrally connected to the cup member 24. As shown in FIG. 4, magnetic member 31 is generally disc shaped and has a hole therein designed to accommodate post 30. Post 30 comprises a disc shape plate 29 having a protrusion 30 extending therefrom. The disc shaped plated 29 also has openings formed therein for accommodating one or more screws 35. Post 28 is fixed to the end 22 of the cup member 20 by screws passing through openings 32 and being fixed in the bosses 24. Magnetic member 31 is then attached to post 28 via double sided tape 33.

As shown in FIG. 9, an exemplary length $d_{10}$ of post 28 is 0.3 inches and the length $d_9$ of disc 29 is 0.04 inches. The length of protrusion 30 is preferably from about 0.1 inch to about 1 inch, and more preferably 0.2 inches to 0.5, and more preferably about 0.25 inches. An exemplary width $d_8$ is about 0.6 inches.

An alternative method of connecting the magnetic member 31 to the end face 22 of cup member 20 is shown in FIG. 5. Specifically, in the embodiment of FIG. 5, magnetic member 31 has a through hole to accommodate protrusion 30 and two holes to accommodate screws 35. The magnetic member and post 28 are fixed to the end face of the cup member 20 by screws passing through holes in the magnetic member 32, holes 32 in plate 29 and seated in bosses 24 of cup member 20.

While protrusion 30 and magnetic member 31 are shown as separate bodies in FIGS. 4 and 5, the protrusion may be integrated with the magnet.

One of ordinary skill in the art would recognize that many alternative methods to connect magnet member 31 and protrusion 30 at the end face.

Second Embodiment

A second embodiment of the present invention is shown for instance in FIGS. 12-16. As shown in FIGS. 12-16, one aspect of the present invention is directed to a stylus 101 comprising a connection portion 102 that comprises a first end 114 defining an opening 115 and a bore 112, the connection portion 102 being adapted for attaching and detaching a brush head 105 to the stylus 101, a grip portion 104 adapted for being comfortably gripped with the hand of a user, a second end portion 103 opposite the first portion 102 and a connection mechanism, preferably a connection mechanism of the type shown in FIG. 15(*a*)-15(*e*) that is adapted to engage a brush head so that the brush head is reversibly attached to the stylus.

Figure 13:
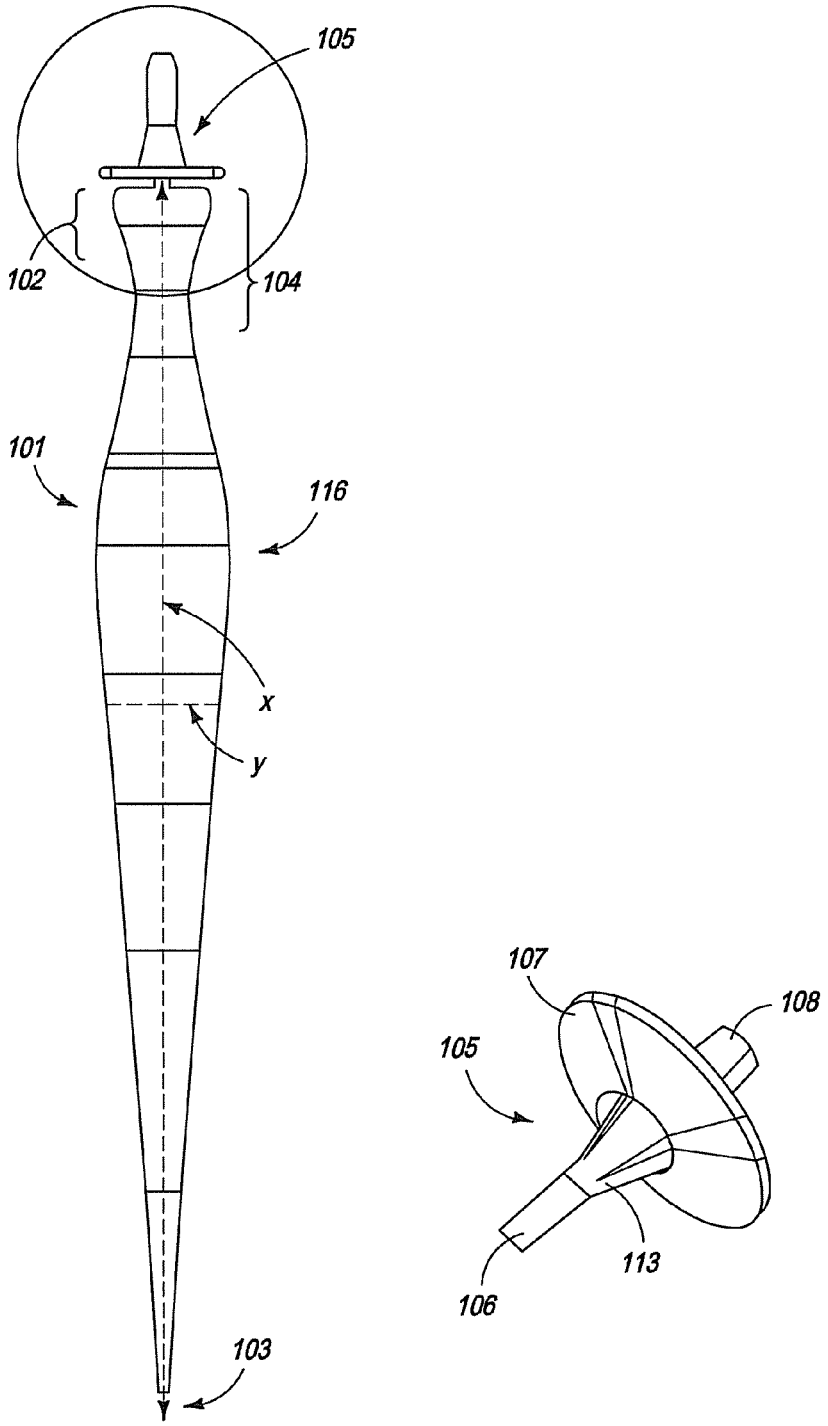
FIG. 13 is a side view of a cosmetics applicator including a stylus and detachable brush head according to the second embodiment of the present invention.

As shown in FIG. 13, the stylus has a major axis, X, referred to herein as the longitudinal direction, and a minor axis, Y, referred to herein the thickness (or width) direction, and the stylus is longer along its major axis, X, than the minor axis Y. In generally, the stylus should be sufficiently sized to be comfortably held in the human hand. Preferably, the stylus is between 4 and 9 inches in length along its major axis, and more preferably between about 6 and 8 inches. The stylus may generally be made of any suitable material or combination of materials generally used by the cosmetics industry, so long as the weight of the stylus is such that it may be comfortably held in the user's hand. Suitable materials include plastics and other polymers, woods and metals and combinations thereof.

The stylus 101 preferably includes a grip portion 104. The grip portion 104 is located at a position along the major axis X closer to the first end of stylus than a second end of stylus opposite the first end. The grip portion 104 may overlap the connection portion 102. Preferably, the grip portion begins at or near the first end of the stylus. Preferably, the grip portion begins less 3 inches, preferably less than about 2 inches, and more preferably less than 1 inch from the first end of the stylus in the direction of the major axis. In the gripping portion 104, the thickness of the stylus in the direction the minor axis should be greater than one-sixteenth of an inch, and preferably greater than one-eighth of an inch. The position and size of the grip portion 104 is such that a user may grasp the stylus between the tip of the thumb and the lower edge of the middle finger just above the fingernail. Preferably, the tip of the index finger to rest on the stylus, in a so-called tripod configuration. By locating the gripping portion near to the end of the stylus, the stylus of this embodiment can permit a user to place their hand closer to the brush and to the nail being polished, thus centering the locus of control nearer to the nail surface than in conventional nail polish systems, thereby providing greater fine control and manipulation of the applicator by a user.

The stylus 101 preferably includes a thickened portion of the stylus that is thicker along the direction of the minor axis, Y, then the other portions of the stylus. In this embodiment, the stylus is thinner along the minor axis in the grip portion 104 than it is at the thickened portion 116. More preferably, the stylus is tapered in a direction from the thickened portion 116 to the connection portion 102. This provides a Grip Region 104 that better accommodates gripping by the human hand and improves visibility of the nail surface on which the polish is to be applied. The stylus is also preferably tapered in a direction from the thickened portion 104 to the second end portion 103. This permits the weight to be adjusted that it may be suitably for ease and comfort of use.

The connection portion 102 of stylus 101 defines a first end having an opening therein and a bore 112 adapted for holding the brush head 5. Specifically, as shown in FIG. 2, a brush head 105 according to the present invention comprises a brush 106 connected to a shield 107 vial ferrule 120 and a connector 108. The bore 112 of the connection portion 102 is sufficiently sized to accommodate the connector 108 in the connection portion 102 and to engage the connection mechanism of the stylus so that the brush head 105 may be reversibly attached to the stylus 101. In some embodiments the stylus, the wall(s) 113 of the bore 112 may be shaped appropriately to suitably attach the brush head 105 to the stylus 101, and in these embodiments, the bore 112, including the required shape of the wall(s) 113, constitute the connection mechanism of the stylus 101. In other embodiments, bore 112 may accommodate at least a part of the connection mechanism, and in these embodiments, bore 112 should be suitably shaped to permit the connector 108 of brush head 105 to operatively engage the connection mechanism of the stylus 101. The specific size, shape and arrangement of the bore 112 in the end portion 102 depends upon the selected connection mechanism as would be understood by those of ordinary skill in the art.

The connection mechanism chosen should result in a stable connection strong enough to permit the application of nail polish to the brush and also to permit application of the nail polish deposited onto the brush to the nail. The selected mechanism should allow a user to reversibly attach the brush head before use and detach the brush head after use. Preferably in this embodiment, the selected mechanism permits a user to eject or remove the brush head from the stylus using only one hand. This is because, when the applicator is used, a user may wish to remove the brush head while the nails of the hand are wet, which is associated with decrease manual dexterity and fine control. It should be understood that that the connection mechanism of the stylus may require certain complementary structures on the connector 108 of the brush head 106 in order to establish a secure connection, but it should be understood that the connection mechanism of the stylus 101 refers only to the structure within the stylus adapted for establishing the connection.

As shown in FIG. 13, a brush head 105 according to the present invention comprises a brush 106 connected via ferrule 113 to a first surface of shield 107 and a connector 108 on a second surface of shield 107. The brush 106 may generally be any brush form that is suitable for use in connection with nail polish application. Certain alternative style brushes 109, 110 and 111 attached to brush heads are shown in FIG. 1, including a dotting tool 109, a second brush shape 110, and a striping brush 111.

The shield 107 of brush head 105 should be sized and shaped in a manner that prevents nail polish from traveling from the brush or ferrule 113 onto the connector 108. Preferably, the shield 107 is a flat disc shaped body. The shield 107 is also preferably shaped such that it prevents nail polish from traveling into the bore 112 of the stylus 101 or reaching the connection mechanism of stylus 101. Preferably, the shield 107 covers the opening of bore 112 when the brush head 105 is attached to the stylus 101. The ferrule 113, shield 107 and connector 108 may be a single integrated body or the ferrule 113, shield 107 and connector 108 may be separate structures that as suitable joined together as would be appreciated by those ordinarily skilled. The brush head 105 may be disposable, even after a single use.

In the present invention, a suitable connection of the brush head 105 to the stylus 101 is effectuated by engaging the connector 108 of brush head 105 with the connection mechanism of the stylus 101. Suitable connections include those shown in FIGS. 12-15. Other suitable connection include button activated release connections, wherein the button is placed adjacent to the second end portion 102 of stylus 10, or alternatively, wherein the button is near the grip portion 104 of stylus 101 as closer to the connection portion 2.

The embodiment of FIGS. 12-15 generally depict an applicator comprising a stylus and brush head in which the brush head is connected to and detached from the stylus manually by the user. In this embodiment, the connection is established when a user manually insert the brush head 105 into the bore 112 of the stylus 1. The brush head 105 is detached when a user manually removes brush head 105 from the stylus 101 by pulling. Exemplary types of connection are a small magnet based connection (FIG. 15(*a*)), a large magnet based connection (FIG. 15(*b*)), a ball and spring connection (FIG. 15(*c*)), a Friction connection (FIG. 15(*d*)) and a grooved connection (FIG. 15(*e*)).

Figure 15A:
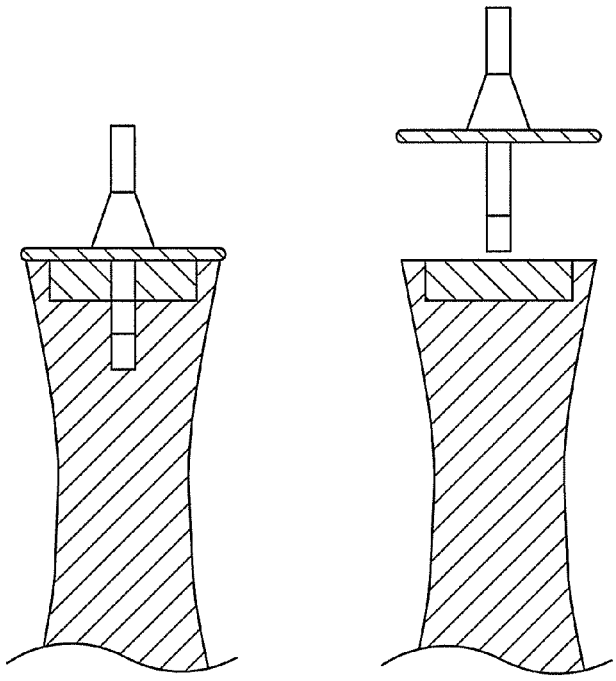
FIGS. 15(*a*)-15(*e*) show different connection mechanisms for detachably connecting the brush head to the stylus according to the second embodiment of the present invention.

As shown in FIG. 15A, the small magnet connection involves attractive force two magnets of opposite polarity or between at least one magnet and a metal plate, a first larger magnet having a first polarity accommodated in bore 112 of the stylus 101 and a smaller magnet of a second opposite polarity (or a metal plate) on the connector 108 of the brush head 105. The magnetic force holds the brush head 105 in the bore 112 of the stylus 101 until the brush head is manually removed by the user. Alternatively, a button activated mechanisms may be used to release the brush head 105 from the stylus 101 by pressing the brush head 105 beyond the range of the magnetic attractive force, therefore, releasing brush head 5 from the stylus 1. The button may be placed near, but preferably outside the grip portion 102 of the stylus or near the second end portion 103 of the stylus.

Figure 15B:
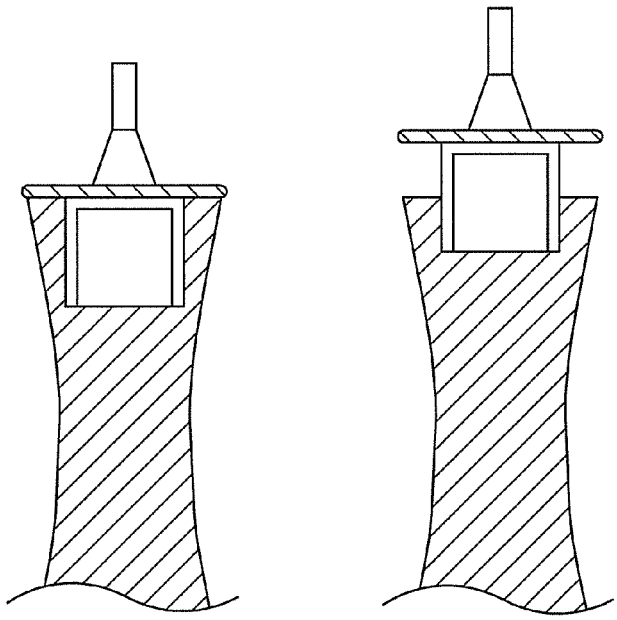
Figure 15C:
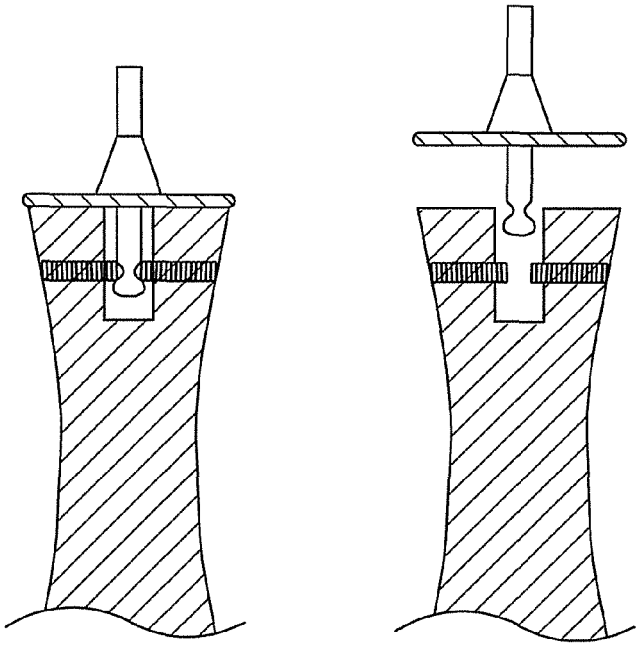
Figure 15D:
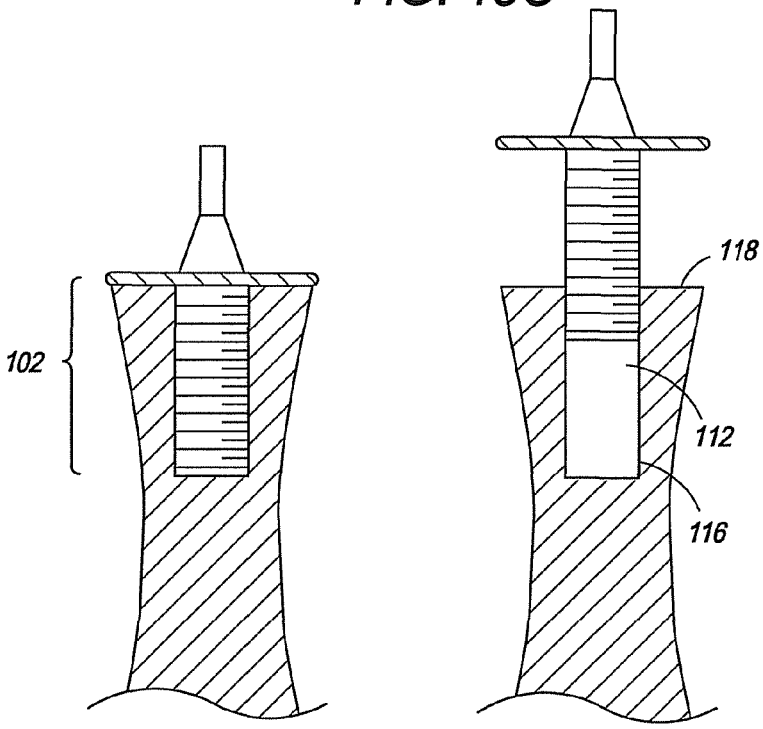
Figure 15E:
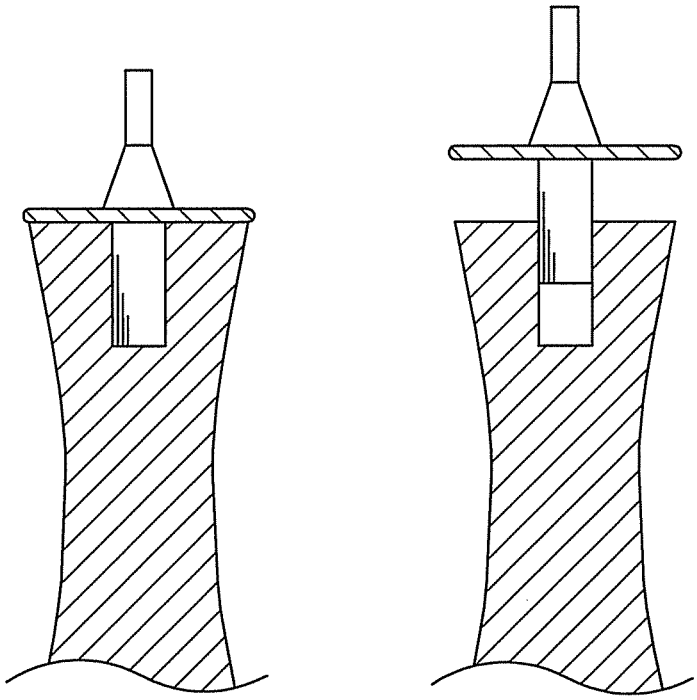

As shown in FIG. 15B, the large magnet connection 2 magnets involves attractive force two magnets of opposite polarity or between at least one magnet and a metallic plate, one on the connector of the brush head 105 and another in the bore 112 of stylus 101. This larger magnet on the connector of this embodiment adds structural support to the connection when placed into the bore 112 of the stylus 101. The magnetic force holds the brush head 105 in the bore of the stylus until the user manually removes the brush head from the stylus 101. Alternatively, use of button activated mechanisms may be used to release the brush head 105 from the stylus 101 by pressing the brush head 105 beyond the range of the magnets' attractive force, therefore, releasing brush head 105 from the stylus 101. The button may be placed near but preferably outside the grip portion 104 of the stylus or near the second end portion 3 of the stylus.

Another suitable connection is a ball and spring connection as shown in FIG. 15(*c*). In embodiment, the bore 112 of the stylus 101 accommodates a ball and spring. When a user manually pushes the connector 108 of the brush head 105 into the bore 112 of the stylus 101. The brush head 105 slides past the balls and is held firmly in place by the ball, which is forced into a recess in the shaft of the head. Alternatively, use of button activated mechanisms may be used to release the brush head 105 from the stylus 101 by forcing the ball out of the recess, thereby loosening the brush head 105 from the stylus 101. The button may be placed near, but outside the grip portion 104 of the stylus or at or near the second end portion 3 of the stylus.

Figure 14A:
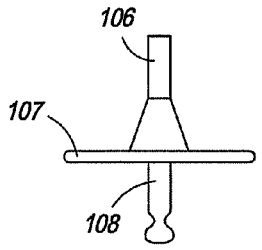
FIGS. 14(*a*)-14(*e*) show different brush head connectors useable in connection with the second embodiment of the present invention.
Figure 14B:
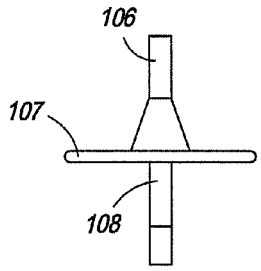
Figure 14C:
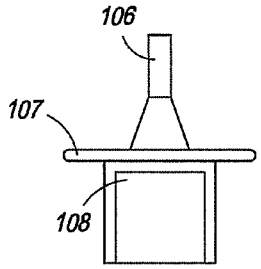
Figure 14D:
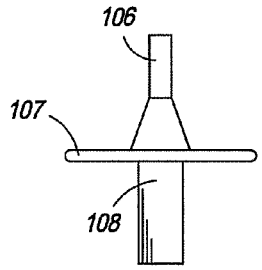
Figure 14E:
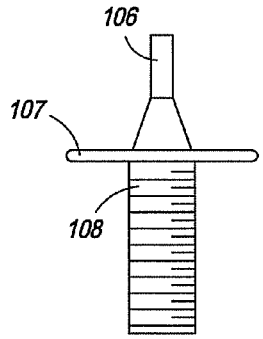

Another suitable connection is a friction grip connection as shown in FIG. 14D. A friction grip connection generally comprises a rubber lining on the walls 13 of the bore 12 such that when the brush head 14 is inserted manually, the rubber lining attached to the walls 13 of the bore 12 holds the brush head 5 in place. Alternative, the lining can be placed on the connector 8 of the brush head 5. Alternatively, as shown in FIGS. 11E, 12E, 15E and 16E, in other embodiments, use of button activated mechanisms may be used to release the brush head 5 from the stylus 1 by forcing the ball out of the recess, thereby loosening the brush head 5 from the stylus 1. The button may be placed near the, but outside of the grip portion 4 of the stylus (FIG. 14) or at or near the second end portion 3 of the stylus (FIG. 10).

Another suitable connection is a grooved connection as shown in FIG. 15(*e*). In this embodiment, the connector 108 of brush head 105 comprise a protruding groove. The connection is made when the user to insert the head into the bore 12 of the stylus 1. The secure connection is made because the connector 108 and bore 112 are sized such that the grooves are under forced tension will maintains the brush head 105 in place. The use of either click or manual mechanism is used to release it, pressing it out of its grooved base and thereby loosening it from the main body. Alternatively, in other embodiments, use of button activated mechanisms may be used to release the brush head 105 from the stylus 101 by forcing the ball out of the recess, thereby loosening the brush head 105 from the stylus 101. The button may be placed near, but outside of the grip portion 4 of the stylus or near the second end portion 3 of the stylus.

It should be noted that connections shown in FIGS. 15(*a*)-15(*e*) are not mutually exclusive and may be used in combination. For instance, use of combination of two or more or either a magnet based connection, friction based, groove based or ball and spring based mechanism may be advantageous.

The embodiment of FIGS. 5-8 generally depict an applicator comprising a stylus and brush head is which the brush head is connected to the stylus manually by a pushing action, which engages a grab mechanism, referred to herein as a "grip," accommodated inside the bore 12 of the stylus 1. In the embodiment of FIGS. 7A and 8A, the connector 8 of the brush head 5 comprises notched ring, i.e. a groove in the surface of the connector 8. The grip is accommodated in the bore 12 of the stylus 1 and when the connector 8 is inserted in the bore 12, the grip engages the groove and the brush head 5 in place until release mechanism is activated, thus releasing the grip from the groove and loosening the head.

It should be noted that the nail polish applicator, which includes the stylus and the brush head, is suitable for use with conventional nail polish formulations. However, the applicator is generally not required to be capable for use with nail polish housed in traditional bottles. Thus, another embodiment of the present invention is a system for polishing nails comprising the applicator according to the present invention and at least one nail polish container. The contain useable in connection with the present invention has a wide opening and is shallow in comparison to conventional nail polish containers. The broad opening nail polish container of the present invention accommodates the applicator of present invention and permits the user to finely control the amount of polish on the brush. It also allows the user to avoid getting nail polish on any other portion of the applicator other than the brush. In a preferred embodiment, the system includes at least two containers containing different colored polish. In another embodiment, the system of the present invention contains at least 2 brush heads having different brushes. In another embodiment of the present invention, the system includes a plurality of brushes, at least one for each color included in the system.

Figure 16A:
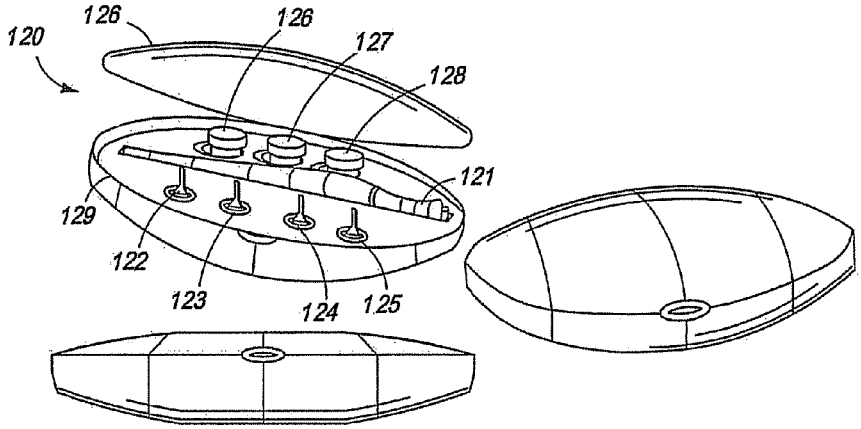
FIGS. 16(*a*) and 16(*b*) show kits for applying nail polish according to another embodiment of the present invention.
Figure 16B:
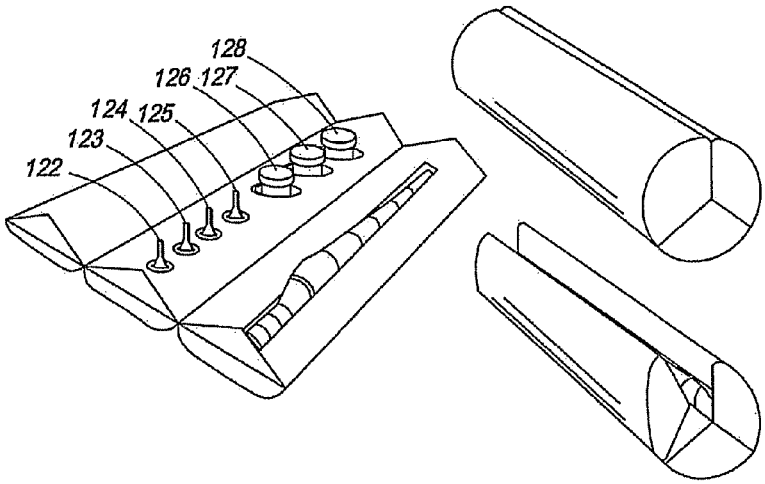
Figure 17:
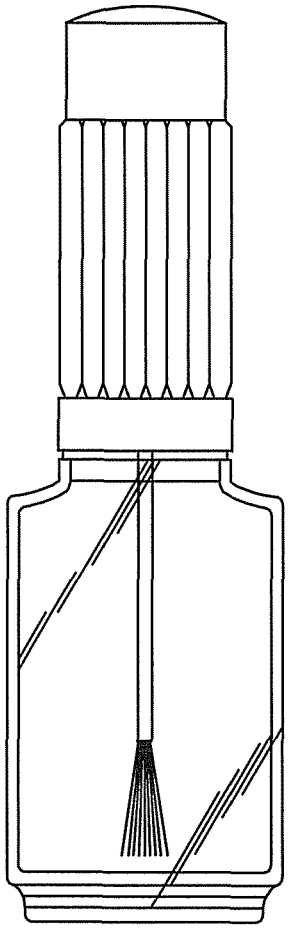
FIG. 17 Prior Art
FIG. 17 shows a conventional nail polish bottle and applicator.

Another embodiment of the present invention is directed to a kit for polishing the nails of a human comprising an stylus adapted for accommodating a brush head, at least one brush head that reversibly attaches to the applicator, at least one nail polish container enclosing nail polish, and a container. Alternative embodiments, showing different containers are shown in FIGS. 16(*a*) and 16(*b*). As shown in exemplary embodiment of FIG. 16(*a*), the kit 120 includes a stylus 121 according to the present invention, four brush heads, including a dotting tool 122, a striping brush 123, a first brush 124 and a second brush 125 have different brushes attached respectively to each, three nail polish containers 126, 127, and 128, preferably containing nail polish, and more preferably, different color nail polishes, and container 129. The interior of container 129 is formed so as to securely hold the contents of the kit during storage. In the embodiment of FIG. 16(*a*), the container comprises a base and a lid, so that, when the container is closed, the contents are enclosed within the container and the contents are protected from accidental damage. The lid may be attached to the base by a hinge.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims. Those skilled in the art will recognize, or be able to ascertain using no more than routine experimentation, many equivalents to the specific embodiments of the method and compositions described herein. Such equivalents are intended to be encompassed by the following claims.

The invention claimed is:

1. A stylus for use in the application of a cosmetic comprising:

a wand member having a beveled end with a bevel angle and a second end opposite the beveled end;

a cup member having a beveled end with the bevel angle and second end opposite the beveled end;

a connection member comprising one of a magnet or a metallic material, the connection member being fixably attached to the second end of the cup member; and a protrusion extending from an end face of the second end of the cup member;

wherein the wand member and cup member are rotatably connected along an axis of rotation at their respective beveled ends, wherein the rotation of wand member relative to the cup member is restrained at two or more predetermined positions along the axis of rotation, wherein the beveled end of the wand member comprises at least two detents or at least 2 detent receptacles and the beveled end of the cup member comprises the other of the least two detent or detent receptacles, and the detent receptacles are configured to restrict the rotation of wand member relative to the cup member at the predetermined positions along the axis of rotation when the detents are aligned with the detent receptacles, and wherein the each detent is seated in a corresponding detent receptacle by a spring force directed parallel to the axis of rotation.

2. The stylus according to claim 1, wherein the connection member is a magnetic member.

3. The stylus according to claim 1, wherein, in a first predetermined position, the stylus is aligned along the entire length of its a longitudinal axis.

4. The stylus according to claim 3, wherein in a second predetermined position, the stylus is bent at connection of the cup member and the wand member.

5. The stylus according to claim 1, wherein the beveled end of the wand member comprises a first conic contact surface and the beveled end of the wand member comprises as a second conic contact surface and the first conic surface is engaged with the second conic contact surface and the rotation is along the contact surfaces.

6. A system for polishing nails comprising:

the stylus according to claim 1; and at least one overcap assembly connected to a brush assembly, the overcap assembly being configured to reversibly attach to the stylus; and optionally, at least one container of nail polish.

7. The system according to claim 6, further comprising a plurality of overcap assemblies each having a different brush assemble, each overcap assembly being reversibly attachable to the stylus.

8. A kit for polishing nails comprising:

the stylus according to claim 1;

at least one overcap assembly connected to a brush assembly, the overcap assembly being configured to reversibly attach to the stylus;

at least one container of nail polish;

a container adapted for holding the stylus, the at least one brush and the at least one nail polish.

9. The kit according to claim 8, further comprising a plurality of overcap assemblies each having a different brush assembly, each overcap assembly being reversibly attachable to the stylus.

10. An applicator for use in the application of a cosmetic comprising:

a stylus for use in the application of a cosmetic comprising:

a wand member having a beveled end with a bevel angle and a second end opposite the beveled end:

a cup member having a beveled end with the bevel angle and second end opposite the beveled end;

a connection member comprising one of a magnet or a metallic material, the connection member being fixably attached to the second end of the cup member; and a protrusion extending from an end face of the second end of the cup member;

wherein the wand member and cup member are rotatably connected along an axis of rotation at their respective beveled ends; and an overcap assembly comprising a cap and an overcap member fixably attached to a top surface of the cap, the overcap member being a metallic material or a magnet of suitable polarity, wherein the overcap assembly is reversibly connected to the stylus by a magnetic force between the connection member and the overcap member, wherein the rotation of wand member relative to the cup member is restrained at two or more predetermined positions along the axis of rotation, wherein the beveled end of the wand member comprises at least two detents or at least 2 detent receptacles and the beveled end of the cup member comprises the other of the least two detent or detent receptacles, and the detent receptacles are configured to restrict the rotation of wand member relative to the cup member at the predetermined positions along the axis of rotation when the detents are aligned with the detent receptacles, and wherein the each detent is seated in a corresponding detent receptacle by a spring force directed parallel to the axis of rotation.

11. The applicator according to claim 10, wherein the connection member is a magnetic member.

12. The applicator according to claim 10, wherein, in a first predetermined position, the stylus is aligned along the entire length of its a longitudinal axis.

13. The applicator according to claim 12, wherein in a second predetermined position, the stylus is bent at connection of the cup member and the wand member.

14. The applicator according to claim 10, wherein the beveled end of the wand member comprises a first conic contact surface and the beveled end of the wand member comprises as a second conic contact surface and the first conic surface is engaged with the second conic contact surface and the rotation is along the contact surfaces.

* * * * *